US007431271B2

(12) United States Patent
Gantert et al.

(10) Patent No.: US 7,431,271 B2
(45) Date of Patent: Oct. 7, 2008

(54) CARBURETOR

(75) Inventors: Jochen Gantert, Waiblingen (DE); Gerhard Osburg, Kernen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 234 days.

(21) Appl. No.: 11/466,464

(22) Filed: Aug. 23, 2006

(65) Prior Publication Data

US 2007/0045878 A1 Mar. 1, 2007

(30) Foreign Application Priority Data

Aug. 24, 2005 (DE) ..... 10 2005 039 926

(51) Int. Cl.
*F02M 7/12* (2006.01)

(52) U.S. Cl. ..... 261/52

(58) Field of Classification Search ..... 261/52, 261/61

See application file for complete search history.

(56) References Cited

U.S. PATENT DOCUMENTS

| | | | | | |
|---|---|---|---|---|---|
| 2,929,226 | A * | 3/1960 | Baker et al. | 62/215 |
| 3,575,385 | A * | 4/1971 | Szwargulski et al. | 261/23.2 |
| 4,123,480 | A * | 10/1978 | Johansson | 261/52 |
| 4,983,330 | A * | 1/1991 | Harbeke | 261/52 |
| 5,500,159 | A * | 3/1996 | Martinsson | 261/52 |
| 5,611,312 | A * | 3/1997 | Swanson et al. | 123/436 |
| 6,000,683 | A * | 12/1999 | Van Allen | 261/52 |
| 6,494,439 | B1 * | 12/2002 | Collins | 261/52 |
| 6,641,118 | B2 * | 11/2003 | Schliemann | 261/52 |
| 7,104,527 | B2 * | 9/2006 | Koizumi | 261/52 |
| 2001/0013664 | A1 * | 8/2001 | Kobayashi | 261/52 |
| 2002/0121710 | A1 * | 9/2002 | King et al. | 261/52 |
| 2003/0052422 | A1 | 3/2003 | Schliemann | |

FOREIGN PATENT DOCUMENTS

| | | | | |
|---|---|---|---|---|
| JP | 59-155544 | A * | 9/1984 | 261/52 |

* cited by examiner

*Primary Examiner*—Richard L Chiesa
(74) *Attorney, Agent, or Firm*—Gudrun E. Huckett

(57) ABSTRACT

A carburetor has a housing with an intake channel section. A throttle element and a choke element are arranged in the intake channel section and are adjustable between a closed position in which a flow cross-section of the intake channel is substantially closed and an open position in which the flow cross-section of the intake channel is substantially released. The choke element has a start position in which the flow cross-section of the intake channel is at least partially closed. A coupling device couples the throttle element to the choke element when the choke element is in the start position. The choke element has an enriching position. The coupling device has an actuator that moves the choke element into the enriching position when the throttle element is moved, starting from the start positions of the throttle element and of the choke element, toward the open throttle position of the throttle element.

16 Claims, 3 Drawing Sheets

CARBURETOR

BACKGROUND OF THE INVENTION

The invention relates to a carburetor comprising a housing in which an intake channel section is provided. In the intake section a throttle element and a choke element are arranged and each one is adjustable between a closed position in which the flow cross-section of the intake channel is substantially closed and an open position in which the flow cross-section of the intake channel is substantially released. The choke elements has at least one start position in which it closes off the flow cross-section of the intake channel at least partially. A coupling device is provided that couples, in the start position of the choke element, the position of the throttle element to the position of the choke element.

U.S. 2003/0052422 A1 discloses a carburetor with a coupling device connecting a throttle flap and a choke flap. For starting the engine, the choke flap is moved into a start position. By means of the coupling device, the throttle flap is actuated and also moved into the start position. After the engine has been started, the coupling is released between the throttle flap and the choke flap by opening the throttle, i.e., by rotation of the throttle flap into the open position. When releasing the coupling action, the choke flap is moved into a completely open position because it is spring-loaded. In this way, the fuel/gas mixture becomes suddenly lean.

SUMMARY OF THE INVENTION

It is an object of the present invention to provide a carburetor of the aforementioned kind with which an excessive leaning of the fuel/gas mixture after starting the engine is prevented.

In accordance with the present invention, this is achieved in that the choke element has an enriching position and in that the coupling device has an actuator that moves the choke element into the enriching position when the throttle element, from the start positions of throttle element and choke element, is adjusted in the direction toward the open position.

When further acceleration is taking place, i.e., when the throttle element is moved into the open position, the actuator that adjusts the choke element after starting the engine into the enriching position effects an additional mixture enrichment after starting. The intake channel is not suddenly completely released by the choke element but is first still kept in a partially closed position. In this way, excellent acceleration of a combustion engine can be achieved Preferably, the choke element in the enriching position is arranged in a position between the closed position and the open position and, in particular, is moved by less than half of the adjusting stroke required for moving from the open position to the closed position. The enriching position corresponds preferably approximately to the warm start position of the choke element. In this way, an additional enrichment upon acceleration of the engine from the start position is achieved without causing a mixture that is too rich. It is provided that the choke element is spring-loaded in the direction toward its open position and the throttle element is spring-loaded in the direction toward the closed position. In this way, it is ensured that, when releasing the coupling device, the choke element is returned to its open position. The spring actuation of the throttle element in the direction of its closed position enables locking of the throttle element and the choke element by means of the coupling device.

It is provided that the actuator releases the choke element from the enriching position when the open position of the throttle element is reached. This is in particular provided when the carburetor is used in a hand-held power tool that has a securing device for the throttle lever. When operating such a power tool, the throttle element is moved into the completely open position after starting the engine and subsequently secured in this position because the power tool runs under full load in operation. For example, this is the case for blowers or the like. For such power tools, a movement of the choke element into the enriching position is provided after starting in order to enable a powerful acceleration of the internal combustion engine. When the open position of the throttle element is reached, i.e., the full load position, the choke element is released in order to prevent that during operation the mixture is permanently enriched. However, in particular in the case of power tools that have no securing device for the throttle lever, it can also be provided that the actuator releases the choke element when adjusting the throttle element in the direction toward the closed position. In this way, an additional enrichment during the initial full load operation after starting is achieved. After initial full load operation, i.e., when the throttle element is adjusted to partial load position or idle position, the choke element is released so that additional enrichment no longer takes place.

It is provided that the coupling device releases the choke element when the throttle element is adjusted from the start positions of choke element and throttle element in the direction toward the closed position. When adjusting the throttle element in the direction toward the closed position, i.e., when adjusting in the direction toward the idle position, an additional enrichment of the mixture is not required so that the choke element is released and, as a result of the spring action, is returned into its open position.

When adjusting the choke element from the open position into the start position, it is provided that the coupling device moves the throttle element from the closed position into a start position in which the throttle element partially closes the intake channel. For starting the internal combustion engine, it is only necessary to adjust the choke element into the start position. The actuation of the throttle element is realized by the coupling device. In this way, it is ensured that the choke element and the throttle element are arranged in a position that is favorable for starting the engine. Operating errors during starting can be prevented.

Preferably, the choke element has a cold start position and a warm start position; in the warm start position the choke element is opened further than in the cold start position. In the cold start position and in the warm start position of the choke element, the coupling device couples the position of the throttle element to the position of the choke element. By adjusting the choke element, the operator can preset the starting conditions in the cold start position and in the warm start position, respectively. The corresponding adjustment of the throttle element is realized by the coupling device so that for the cold start as well as the warm start optimal positions of the choke element and of the throttle element can be adjusted in a simple way. Preferably, the throttle element has approximately the same position in the warm start position and in the cold start position.

A simple configuration of the coupling device results when the coupling device has a throttle lever that is coupled to the position of the throttle element and a choke lever that is coupled to the position of the choke element wherein the two levers engage one another in the start positions of the choke element and of the throttle element, in particular, in cold start position and in warm start position. By means of the two levers, a simple coupling with a few components can be realized. Preferably, the throttle element is supported by a throttle shaft and the throttle lever is fixedly connected to the throttle shaft. In particular, the choke element is supported by a choke shaft and the choke lever is fixedly connected to the choke shaft. The direct fixed arrangement of the levers on the throttle shaft and the choke shaft, respectively, provides a simple configuration. The positions of the throttle element and of the choke element can be set in a simple and precise way.

It is provided that the throttle lever has an arm that engages the choke lever in the start positions of choke element and throttle element. The actuator that adjusts the choke element into the enriching position is in particular a nose on the throttle lever. The determination of the start positions of throttle element and choke element and the position of the choke element in the enriching position is therefore provided by different sections of the throttle lever. Preferably, the radial extension of the arm relative to the longitudinal axis of the choke shaft is greater than the radial extension of the nose relative to the longitudinal axis of the choke shaft. In this way, a minimal deflection of the choke element in the enriching position can be realized in a simple way. The nose and the arm are arranged on the throttle lever preferably at a spacing relative to one another in the circumferential direction of the throttle shaft. In particular, in the warm start position a section of the choke lever is in the area between the arm and the nose. With this arrangement it is ensured that an adjustment of the choke element into the enriching position is realized after starting the engine. Upon further adjustment of the throttle element, i.e., upon reaching the open position or upon adjusting the throttle element from the open position in the direction toward the closed position, the choke element is released from the enriching position and pivoted in the open position. In this way, the choke lever becomes disengaged from the throttle lever so that during further operation a coupling of the position of the choke element to the position of the throttle element is no longer present.

DESCRIPTION OF THE PREFERRED EMBODIMENTS

Figure 1:
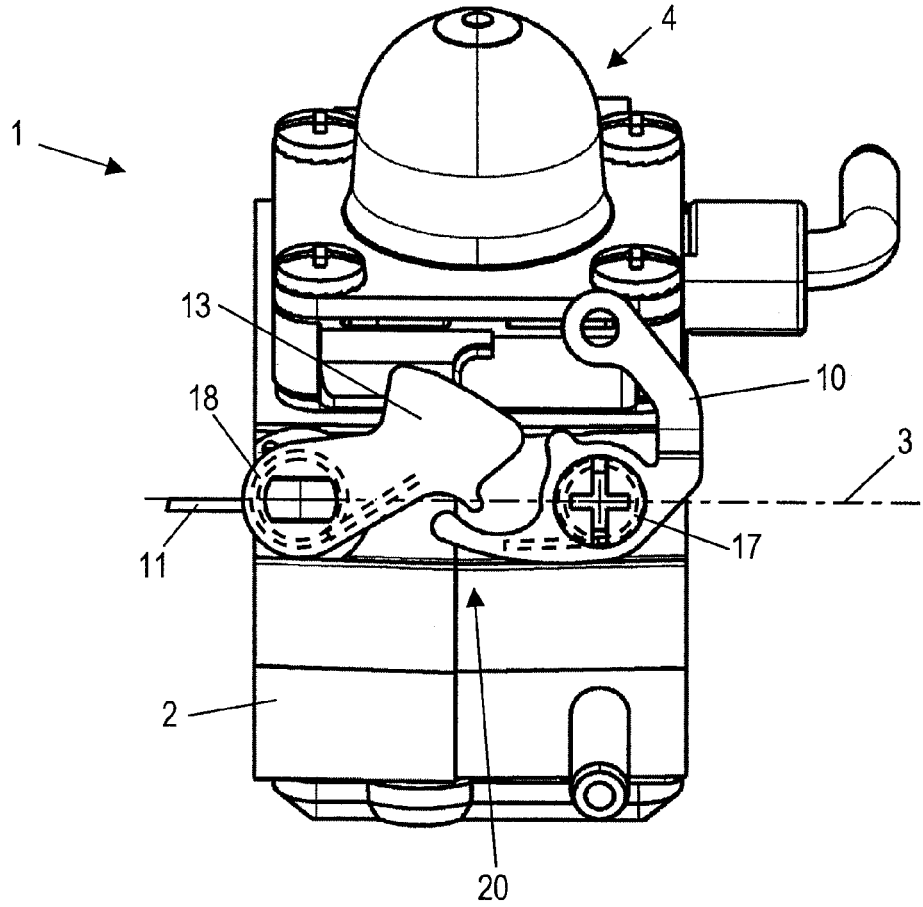
FIG. 1 is a perspective illustration of a carburetor.

The carburetor 1 illustrated in FIG. 1 is a diaphragm carburetor. The carburetor 1 has a housing 2 in which an intake channel section is formed (not shown in FIG. 1). The intake channel section forms a section of an intake channel for supplying a fuel/air mixture to an internal combustion engine, in particular a two-stroke engine. The internal combustion engine is in particular the drive motor of a hand-held power tool such as a motor chainsaw, a cut-off machine, a blower or the like. As shown in FIG. 1, the carburetor 1 has a scavenging pump 4 with which the control chamber, not shown, of the diaphragm carburetor can be flushed with fuel.

Figure 2:
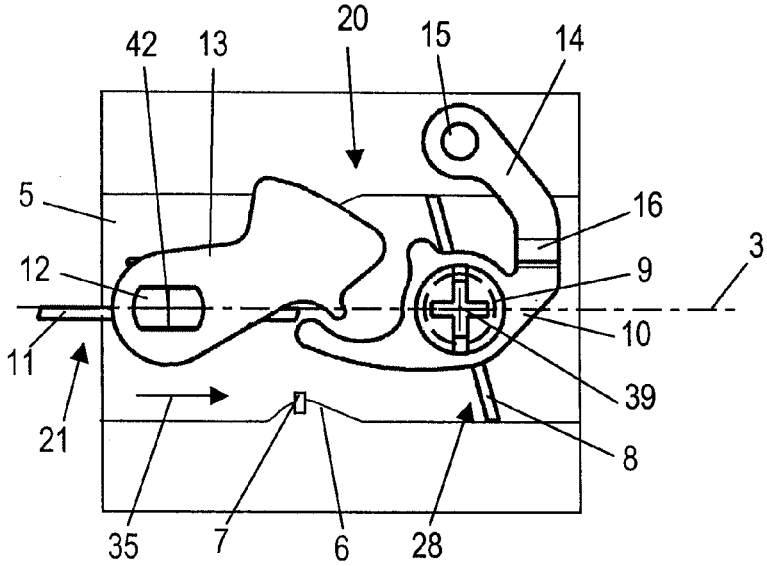
FIG. 2 is a schematic illustration of the carburetor of FIG. 1.

In FIG. 2, the intake channel section 5 in the housing 2 of the carburetor 1 is schematically shown. In the intake channel section 5 a throttle element, i.e., a throttle flap 8 that is pivotably supported by a throttle shaft 9, is arranged. Relative to the flow direction 35, a choke element 6, i.e., a choke flap 11 with a choke shaft 12, is supported pivotably upstream of the throttle flap 8 in the intake channel section 5. The choke flap 11 is supported to be rotatable about longitudinal axis 42 of the choke shaft 12, and the throttle flap 8 is supported to be rotatable about longitudinal axis 39 of the throttle shaft 9.

In an area that is located in the flow direction 35 between the choke shaft 12 and the throttle shaft 9 a venturi 6 is provided in the intake channel section 5. In the area of the venturi 6 a main fuel opening 7 for supplying fuel into the intake channel section 5 is provided. In the area of the throttle flap 8 auxiliary fuel openings are provided that open into the intake channel section 5.

On the throttle shaft 9 a throttle lever 10 and on the choke shaft 12 a choke lever 13 are fixedly arranged. As shown in FIG. 1, the throttle lever 10 and the choke lever 13 are arranged on the outer side of the housing 2 of the carburetor 1. The throttle lever 10 and the choke lever 13 form a coupling device 20. In predetermined positions of the choke flap 11 the choke lever 13 and the throttle lever 10 cooperate with one another and determine the positions of throttle flap 8 and choke flap 11. The choke flap 11 is spring-loaded by spring 18 (shown in FIG. 1), in particular a torsion spring, in the direction of the open choke position 21 illustrated in FIG. 2. The throttle flap 8 is spring-loaded by spring 17 (shown in FIG. 1) in the direction toward the closed throttle position 28 illustrated in FIG. 2.

FIG. 2 shows that the throttle flap 8 closes in its closed throttle position 28 almost completely the flow cross-section of the intake channel. In the open choke position 21 the flow in the intake channel is only insignificantly affected by the choke flap 11. The choke flap 11 is positioned in the open choke position 21 approximately parallel to the longitudinal axis 3 of the intake channel 5. The choke flap 11 as well as the throttle flap 8 are pivotably supported so as to be movable between an open position and a closed position, respectively, in the intake channel.

The throttle lever 10 is provided with an actuating arm 14 that is arranged in a plane upstream of the choke lever 13 and the base member of the throttle lever 10. For this purpose, the throttle lever 10 has a right-angle bend 16 in the actuating arm 14. In this way, the actuating arm 14 does not interact with the choke lever 13. The actuating arm 14 has a fastening opening 15 for a throttle pull that is not illustrated. By means of the throttle pull, the position of the throttle flap 8 is adjusted.

In the open choke position 21 of the choke flap 11 illustrated in FIG. 2, the throttle lever 10 and the choke lever 13 are disengaged. The throttle flap 8 can be adjusted between the closed throttle position 28 illustrated in FIG. 2 and the open throttle position 25 illustrated in FIG. 3 without this affecting the position of the choke flap 11. The choke flap 11 remains in the open choke position 21.

Figure 3:
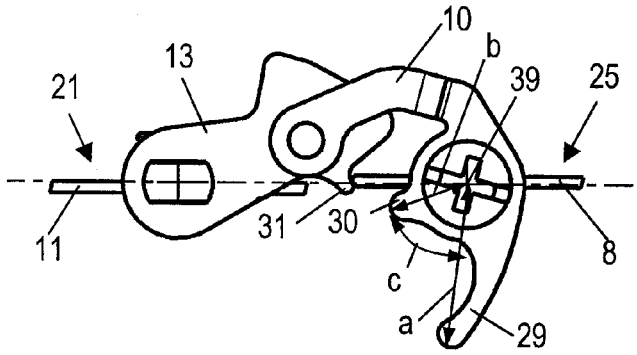
FIG. 3 is a side view of the coupling device of the carburetor of FIGS. 1 and 2 showing a first position of throttle flap and choke flap.

As illustrated in FIG. 3, the throttle lever 10 has an arm 29 and a nose 30 on its circumference. The arm 29 has a radial extension a relative to the longitudinal axis 39 of the throttle shaft 9. The radial extension a is measured relative to the point of the arm 29 that has the greatest spacing relative to the longitudinal axis 39. The nose 30 has a radial extension b relative to the longitudinal axis 39 that is smaller than the radial extension a of the arm 29. Nose 30 has relative to the arm 29 a spacing c in the circumferential direction that is approximately 60 degrees. Advantageously, the spacing is between 30 degrees and 90 degrees.

Figure 4:
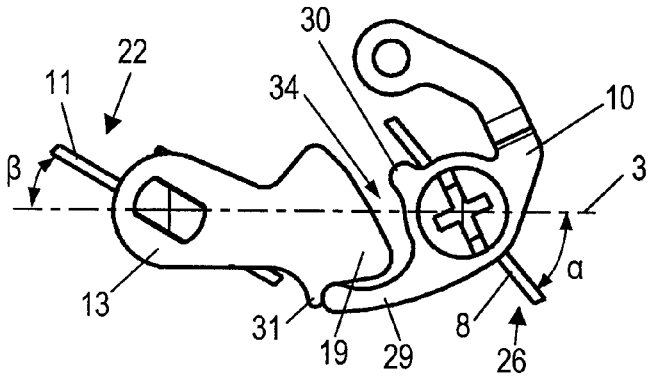
FIG. 4 is a side view of the coupling device of the carburetor of FIGS. 1 and 2 showing a second position of throttle flap and choke flap.

In FIG. 4, the choke flap 11 is in its warm start position 22 and the throttle flap 8 is shown in its warm start position 26. From the rest position (inoperative position) of throttle flap 8 and choke flap 11 shown in FIGS. 1 and 2, the warm start position is reached in that the choke shaft 12 is rotated into the warm start position 22 of the choke flap 11. Preferably, the warm start position 22 is defined by a first catch position. Upon rotation of the choke flap 11 from the open choke position 21 illustrated in FIG. 2 into the warm start position 22, the choke lever 13 engages with the arm 29 the throttle lever 10. The choke lever 13 entrains the throttle lever 10 and actuates the throttle flap 8 in a direction opposite to the force action of the spring 17. The choke lever 13 has a catch 31 where the arm 29 will catch and thus define the warm start positions of throttle flap 8 and choke flap 11. In the warm start position 22 the choke flap 11 and the longitudinal axis 3 of the intake channel section 5 are positioned relative to one another at an angle β that is in particular between 20 degrees and 40 degrees and preferably approximately 30 degrees. The throttle flap 8 is positioned in the warm start position 26 relative to the longitudinal axis 3 of the intake channel at an angle α that is preferably between 40 degrees and 60 degrees and in particular is approximately 49 degrees.

Figure 5:
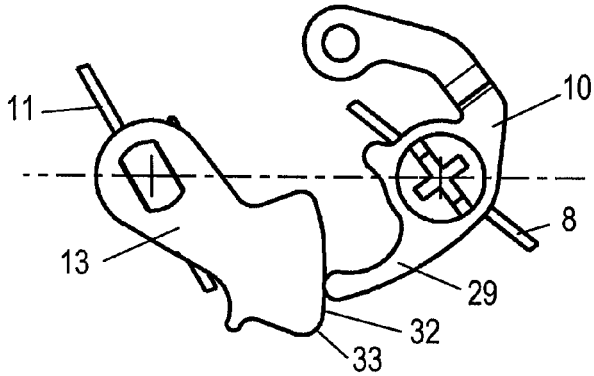
FIG. 5 is a side view of the coupling device of the carburetor of FIGS. 1 and 2 showing a third position of throttle flap and choke flap.

When the choke flap 11 is rotated from the warm start position 22 farther in the direction toward its closed position, the throttle flap 8 is initially closed farther. The choke lever 13 has a locking edge 33 across which the arm 29 is forced. After having passed the locking edge 33, the throttle flap 8 is rotated by the spring 17 about a partial angle back in the direction toward the closed position. FIG. 5 shows that the arm 29 after having passed the locking edge 33 will come to rest against the elongate side 32 of the choke lever 13 and will push the choke lever 13 against the force of the spring 18 in the direction toward the closed choke position of the choke flap 11.

Figure 6:
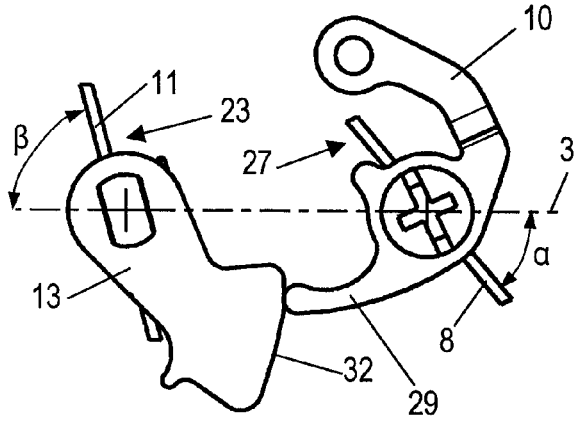
FIG. 6 is a side view of the coupling device of the carburetor of FIGS. 1 and 2 showing a fourth position of throttle flap and choke flap.

In the cold start position 23 illustrated in FIG. 6 the choke flap 11 is preferably in the closed choke position and substantially closes the flow cross-section within the intake channel. The choke flap 11 and the longitudinal axis 3 of the intake channel are positioned relative to one another at an angle β that is preferably between 70 degrees and 80 degrees and in particular is 75 degrees. In the cold start position 27 the throttle flap 8 and the longitudinal axis 3 of the intake channel are positioned relative to one another an angle α that is in particular 40 degrees to 60 degrees and preferably approximately 51 degrees. In the cold start position 27 as well as in the warm start position 26 the throttle flap 8 is thus slanted approximately at the same angle α relative to the longitudinal axis 3 of the intake channel. In the cold start position the arm 29 rests against the elongate side 32 of the choke lever 13.

After having started the engine, the throttle flap 8 is actuated in the direction of the open position. For this purpose, the throttle pull that engages the actuating arm 14 is pulled. Upon actuation of the throttle flap 8 away from the cold start position 27, the arm 29 glides first along the elongate side 32 of the choke lever 13 so that the choke flap 11 is not immediately released but is gradually pivoted. When reaching the locking edge 33, the arm 29 releases the choke lever 13 and the choke lever 13 pivots as a result of the force of the spring 18 in the direction toward the open position. The locking edge 33 is arranged on a section 19 of the choke lever 13 that is arranged in the warm start position illustrated in FIG. 4 in an area 34 between the arm 29 and the nose 30 of the throttle lever 10. As soon as the arm 29 passes the locking edge 33, the choke lever 13 drops with its section 19 into the area 34. The choke lever 13 however cannot return to the open choke position 21 of the choke flap 11 but, as illustrated in FIG. 7, is secured by the nose 30 of the throttle lever 10 in an enriching position 24.

In the enriching position 24 the choke flap 11 and the longitudinal axis 3 of the intake channel are positioned at an angle β relative to one another that is preferably between 15 degrees and 90 degrees, advantageously less than 50 degrees and in particular approximately 30 degrees. Preferably, for reaching the enriching position 24, the choke flap 11 has been moved by less than half of the actuating stroke required between open choke position and closed choke position. The nose 30 is positioned in the enriching position 24 of the choke flap 11 on the elongate side 32 of the choke lever 13. The throttle flap 8 in the embodiment illustrated in FIG. 7 is in the open throttle position. When the throttle flap 8 is rotated away from the open throttle position 25 in the direction toward its closed throttle position 28 (FIG. 2), the nose 30 glides past the locking edge 33 and releases the choke lever 13. The choke flap 11 is returned because of the spring 18 into its open choke position 21. The throttle flap 8 can be actuated without the position of the choke flap 11 being affected. Choke flap 11 and throttle flap 8 are no longer coupled.

Figure 7:
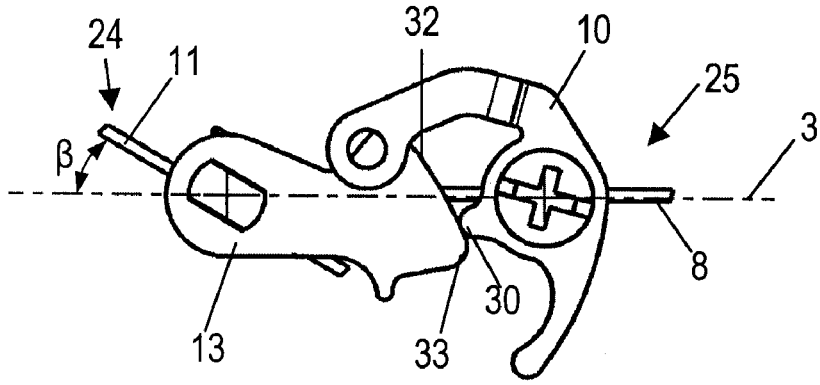
FIG. 7 is a side view of the coupling device of the carburetor of FIGS. 1 and 2 showing a fifth position of throttle flap and choke flap.

Upon actuation of the throttle flap 8 away from the warm start position illustrated in FIG. 4, the nose 30 also engages the elongate side 32 and secures the choke flap 11, as shown in FIG. 7, in the enriching position 24.

Figure 8:
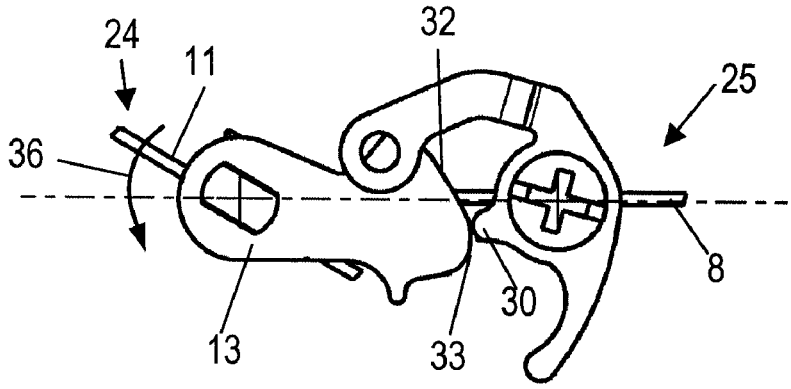
FIG. 8 shows a variant of the coupling device of FIGS. 1 to 7 in a coupling position corresponding to that of FIG. 7.

In the embodiment illustrated in FIG. 8, it is provided that the nose 30 releases the choke lever 13 when reaching the open throttle position 25. When adjusting the throttle flap 8 away from the warm start position 26 illustrated in FIG. 4 or the cold start position 27 illustrated in FIG. 6, the nose 30 first engages the elongate side 32 of the choke lever 13 and moves the choke flap 11 into the enriching position 24. Upon reaching the open throttle position 25 of the throttle flap 8, the nose 30 glides along the locking edge 33 and the choke flap 11 is released and returned in the direction of arrow 36 into the open choke position 21. The release of the choke lever 13 upon reaching the open throttle position 25, i.e., the full load position of the throttle flap 8, is provided in particular for power tools that operates primarily in full load operation.

The illustrated coupling device 20 can be used also in connection with other coupling actions between throttle flap 8 and choke flap 11. In particular, the coupling device 20 is used in the case of a carburetor having an additional air channel for supplying substantially fuel-free combustion air to the internal combustion engine. In the air channel, a throttle element can be provided also whose position is coupled to the position of the throttle flap 8 by means of an additional coupling device. Also, the position of the throttle element in the air channel can be coupled to the position of the choke flap 11.

The specification incorporates by reference the entire disclosure of German priority document 10 2005 039 926.6 having a filing date of 24 Aug. 2005.

While specific embodiments of the invention have been shown and described in detail to illustrate the inventive principles, it will be understood that the invention may be embodied otherwise without departing from such principles.

What is claimed is:

1. A carburetor comprising:

a housing provided with an intake channel section;

a throttle element arranged in the intake channel section and adjustable between a closed throttle position in which a flow cross-section of the intake channel is substantially closed and an open throttle position in which the flow cross-section of the intake channel is substantially released;

a choke element arranged in the intake channel section and adjustable between a closed choke position in which a flow cross-section of the intake channel is substantially closed and an open choke position in which the flow cross-section of the intake channel is substantially released, wherein the choke element has at least one start position in which the choke element at least partially closes the flow cross-section of the intake channel;

a coupling device coupling a position of the throttle element in a start position to a position of the choke element when the choke element is in the start position;

wherein the choke element has an enriching position;

wherein the coupling device has an actuator that moves the choke element into the enriching position when the throttle element is moved, starting from the start position of the throttle element and the start position of the choke element, in a direction toward the open throttle position of the throttle element.

2. The carburetor according to claim 1, wherein the choke element in the enriching position is arranged between the closed choke position and the open choke position.

3. The carburetor according to claim 2, wherein the enriching position is reached when the choke element has moved less than half of an adjusting stroke required for moving from the open choke position into the closed choke position.

4. The carburetor according to claim 1, wherein the choke element is spring-loaded in a direction toward the open choke position and wherein the throttle element is spring-loaded in the direction toward the closed throttle position.

5. The carburetor according to claim 1, wherein the actuator, when the throttle element has reached the open throttle position, releases the choke element from the enriching position.

6. The carburetor according to claim 1, wherein the actuator releases the choke element when adjusting the throttle element from the open throttle position in the direction toward the closed throttle position.

7. The carburetor according to claim 1, wherein the coupling device releases the choke element when the throttle element is moved, starting from the start position of the choke element and the start position of the throttle element, in the direction toward the closed throttle position.

8. The carburetor according to claim 1, wherein, when moving the choke element from the open choke position into the start position of the choke element, the coupling device moves the throttle element from the closed throttle position into the start position of the throttle element in which start position of the throttle element the intake channel is partially closed by the throttle element.

9. The carburetor according to claim 1, wherein the choke element has a cold start position and a warm start position, wherein the choke element in the warm start position is farther open than in the cold start position and wherein the coupling device couples a position of the throttle element to the choke element in the cold start position of the choke element and in the warm start position of the choke element so that a cold start position of the throttle element and a warm start position of the throttle element are defined.

10. The carburetor according to claim 9, wherein the warm start position and the cold start position of the throttle element are approximately identical.

11. The carburetor according to claim 1, wherein the coupling device has a throttle lever that is coupled to a position of the throttle element and further has a choke lever coupled to a position of the choke element, wherein the throttle lever and the choke lever engage one another in the start positions of the choke element and of the throttle element.

12. The carburetor according to claim 11, wherein:

the throttle element comprises a throttle shaft supporting the throttle element in the housing;

the throttle lever is fixedly connected to the throttle shaft;

the choke element comprises a choke shaft supporting the choke element in the housing; and the choke lever is fixedly connected to the choke shaft.

13. The carburetor according to claim 11, wherein the throttle lever has an arm that engages the choke lever in the start positions of the choke element and of the throttle element.

14. The carburetor according to claim 13, wherein the actuator that moves the choke element into the enriching position is a nose on the throttle lever.

15. The carburetor according to claim 14, wherein a radial extension of the arm relative to a longitudinal axis of the throttle shaft is greater than a radial extension of the nose relative to the longitudinal axis of the throttle shaft.

16. The carburetor according to claim 14, wherein the nose and the arm on the throttle lever are arranged in the circumferential direction of the throttle shaft at a spacing relative to one another and wherein a section of the choke lever is arranged in an area between the arm and the nose in the warm start position of the throttle element.

* * * * *